US007624680B2

(12) United States Patent
Metrope

(10) Patent No.: US 7,624,680 B2
(45) Date of Patent: Dec. 1, 2009

(54) ADAPTATION SLEEVE, CORRESPONDING ASSEMBLY AND METHOD FOR MOUNTING

(75) Inventor: Jacques Metrope, Laigneville (FR)

(73) Assignee: Goss International Montataire SA, Montataire (FR)

( * ) Notice: Subject to any disclaimer, the term of this patent is extended or adjusted under 35 U.S.C. 154(b) by 222 days.

(21) Appl. No.: 11/500,245

(22) Filed: Aug. 7, 2006

(65) Prior Publication Data

US 2007/0036922 A1 Feb. 15, 2007

(30) Foreign Application Priority Data

Aug. 9, 2005 (FR) ..... 05 08465

(51) Int. Cl.
*B41F 27/00* (2006.01)
*B41F 27/12* (2006.01)

(52) U.S. Cl. ..... 101/375; 101/376

(58) Field of Classification Search ..... 101/375, 101/376, 465, 37, 480, 216; 492/27, 48; *B41F 27/00, B41F 27/12*

See application file for complete search history.

(56) References Cited

U.S. PATENT DOCUMENTS

| | | | | |
|---|---|---|---|---|
| 3,076,633 | A | 2/1963 | Bridle et al. | 253/77 |
| 3,639,959 | A | 2/1972 | Bagley et al. | |
| 4,864,926 | A * | 9/1989 | Saueressig | 101/153 |
| 4,934,266 | A * | 6/1990 | Fantoni | 101/375 |
| 5,819,657 | A * | 10/1998 | Rossini | 101/376 |
| 6,148,725 | A * | 11/2000 | Knauer et al. | 101/217 |
| 6,357,354 | B1 * | 3/2002 | Dauer et al. | 101/477 |
| 6,371,023 | B1 * | 4/2002 | Francille | 101/375 |
| 2002/0170450 | A1 | 11/2002 | Blanchard | 101/375 |
| 2003/0015107 | A1 * | 1/2003 | Furukawa et al. | 101/143 |

FOREIGN PATENT DOCUMENTS

| | | |
|---|---|---|
| CH | 345 023 A | 4/1960 |
| DE | 10 2004 032 645 A1 | 2/2005 |
| GB | 814647 A | 6/1959 |
| WO | WO 2005/014286 | 2/2005 |

* cited by examiner

*Primary Examiner*—Judy Nguyen
*Assistant Examiner*—Jennifer Simmons
(74) *Attorney, Agent, or Firm*—Davidson, Davidson & Kappel, LLC

(57) ABSTRACT

This format adaptation sleeve for a rotary press comprises an outer surface. In the non-mounted state, the outer surface of the adaptation sleeve is frustoconical.

13 Claims, 3 Drawing Sheets

ADAPTATION SLEEVE, CORRESPONDING ASSEMBLY AND METHOD FOR MOUNTING

The present invention relates to a format adaptation sleeve for a rotary press, of the type comprising an outer surface.

BACKGROUND

In a rotary press, the circumferential length of the printing plate is a parameter which determines the printing length of the product to be printed. In order to increase the flexibility of the press, it is necessary to allow a variation in printing length or a variation in format.

In order to modify the circumferential length of a cylinder having a fixed radius in a press, open adaptation sleeves having different thicknesses can be mounted on a hub. A sleeve of this type is, for example, disclosed in application WO2005/014286 from the same applicant.

The production of a tension mechanism which is intended to tension an open sleeve of this type around a cylindrical hub is complex owing to the requirement to prevent the top and bottom edges of the sleeve from being raised from the hub under the action of the tensile force.

Furthermore, it is known to expand a closed adaptation sleeve by means of a cushion of air in order to be able to mount it on the hub of the press. However, the expansion of a closed sleeve requires very great pressure or involves the use of a sleeve which is both resilient and incompressible, material properties which are generally incompatible.

SUMMARY OF THE INVENTION

An object of the invention is to overcome the disadvantages mentioned and to provide an adaptation sleeve which is easy to mount on the hub.

To this end, the invention provides an adaptation sleeve, when the adaptation sleeve is in the non-mounted state, the outer surface of the adaptation sleeve is frustoconical.

According to specific embodiments of the invention, the adaptation sleeve may comprise one or more of the following features:

the sleeve comprises an inner surface which is cylindrical when the sleeve is in the non-mounted state;

the adaptation sleeve is of resilient material, such as glass fibre which is impregnated with resin;

the adaptation sleeve comprises an axial groove in the outer surface thereof, which groove is suitable for receiving the top edge and bottom edge of a printing plate;

the axial groove has a cross-section which has an undercut in the radial direction, in particular in the form of a dovetail; and the axial groove increases in terms of circumferential width from one of the axial ends thereof to the other axial end.

The invention further relates to an assembly of a hub of a cylinder of a rotary press and an adaptation sleeve, the adaptation sleeve is an adaptation sleeve as defined above, in that the hub has a frustoconical outer surface, and in that the levels of conicity of the outer surface of the hub and the inner surface of the adaptation sleeve, when the adaptation sleeve is not mounted on the hub, are such that the outer surface of the adaptation sleeve is cylindrical when the adaptation sleeve is mounted on the hub.

According to specific embodiments, the assembly according to the invention may comprise one or more of the following features:

the conicity of the outer surface of the hub and the conicity of the outer surface of the adaptation sleeve are identical when the adaptation sleeve is in the non-mounted state;

the adaptation sleeve and the hub each define an end having a large diameter and an end having a small diameter and, when the adaptation sleeve is mounted on the hub, the end of the adaptation sleeve having a large diameter is directed towards the end of the hub having a small diameter and, when the adaptation sleeve is mounted on the hub, the end of the adaptation sleeve having a small diameter is directed towards the end of the hub having a large diameter.

Finally, the invention relates to a method for mounting an assembly including the following steps:

axially aligning the adaptation sleeve with the hub;

fitting the adaptation sleeve to the hub, the adaptation sleeve being resiliently deformed during the fitting operation.

BRIEF DESCRIPTION OF THE DRAWINGS

The invention will be better understood from a reading of the following description, given purely by way of example and with reference to the appended drawings, in which.

DETAILED DESCRIPTION OF PREFERRED EMBODIMENTS

Figure 1:
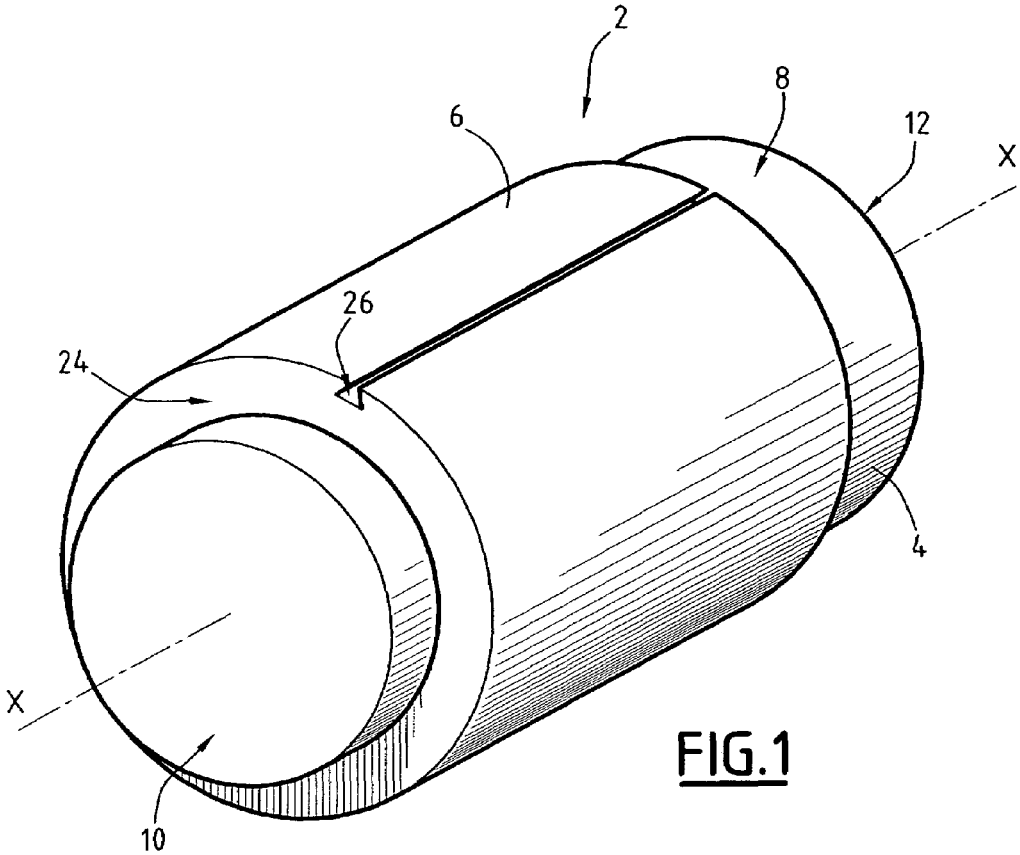
FIG. 1 is a schematic perspective view of an assembly of a sleeve and a hub according to the invention.
Figure 4:
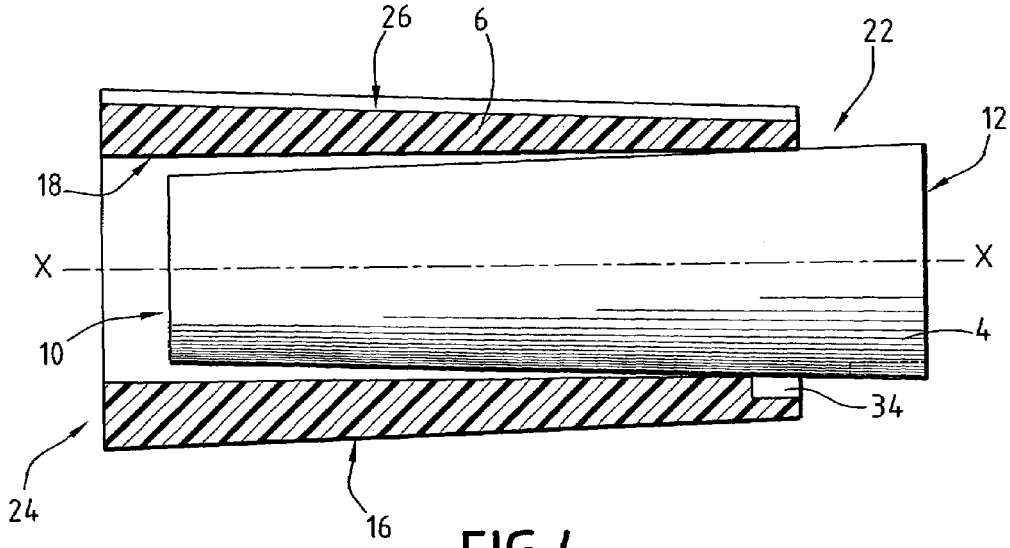
FIG. 4 is a view similar to that of FIG. 2A, during the mounting of the adaptation sleeve on the hub.

FIG. 1 illustrates an assembly according to the invention, generally designated 2.

The assembly 2 comprises a hub 4 of a rotary press and an adaptation sleeve 6.

The hub 4 extends along a centre axis X-X and is connected to means for driving in terms of rotation, such as an electric motor.

Figure 2B:
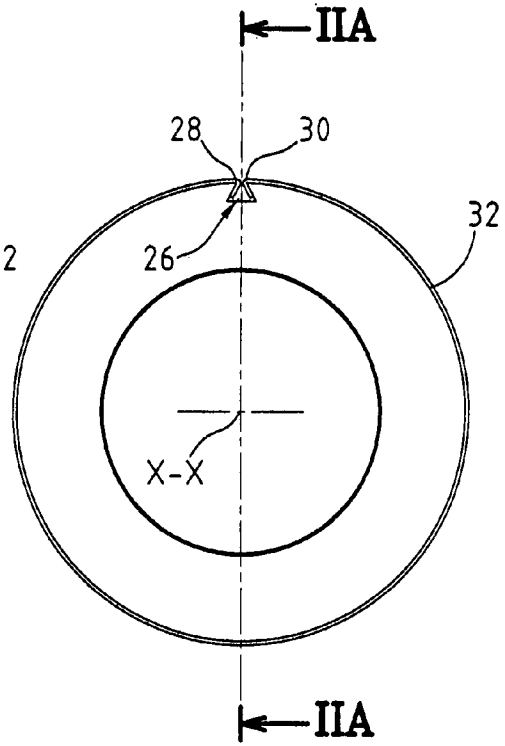
FIG. 2B is an axial view in direction IIB of FIG. 2A.
Figure 2A:
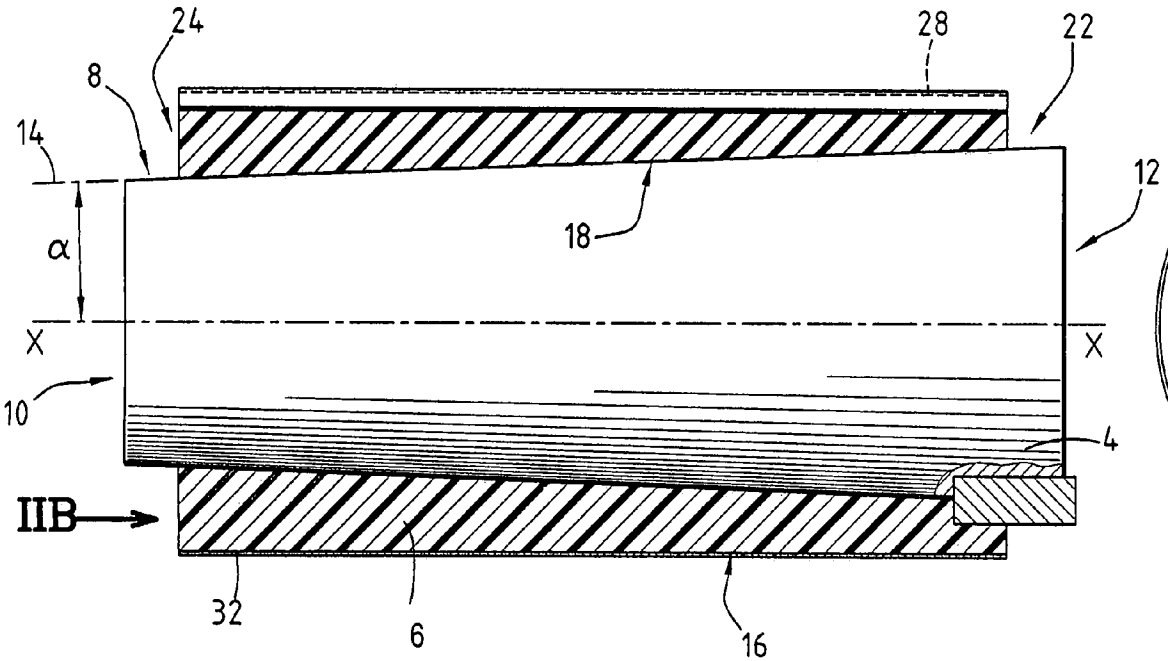
FIG. 2A is an axial section of the assembly of FIG. 1 and a printing plate.

The hub 4 comprises an outer surface 8 which has a frustoconcial form with rotational symmetry about the axis X-X. The hub 4 thus forms an end 10 having a small diameter and an end 12 having a large diameter. As indicated in FIG. 2A, a generating line 14 of the outer surface 8 is inclined through an angle $\alpha$ relative to the axis X-X. This angle $\alpha$ is, for example, between 3 minutes and 1 degree.

The adaptation sleeve 6 is a sleeve which is closed over the entire periphery thereof. The adaptation sleeve extends along a centre axis Y-Y which, in the mounted state, coincides with the axis X-X.

The adaptation sleeve 6 is produced from a conventional material which is resilient, at least in the circumferential direction thereof, such as a plastics material or a composite material. The material is, for example, glass fibre impregnated with resin.

In a variant, the adaptation sleeve 6 is produced from a material having little resilience, such as metal which is made expandable by a series of through-holes which are parallel with the axis thereof. In this instance, the strength of the sleeve in terms of extension is controlled by the number of holes which are formed at the periphery thereof. This same principle can be applied to a non-metal material.

Figure 3A:
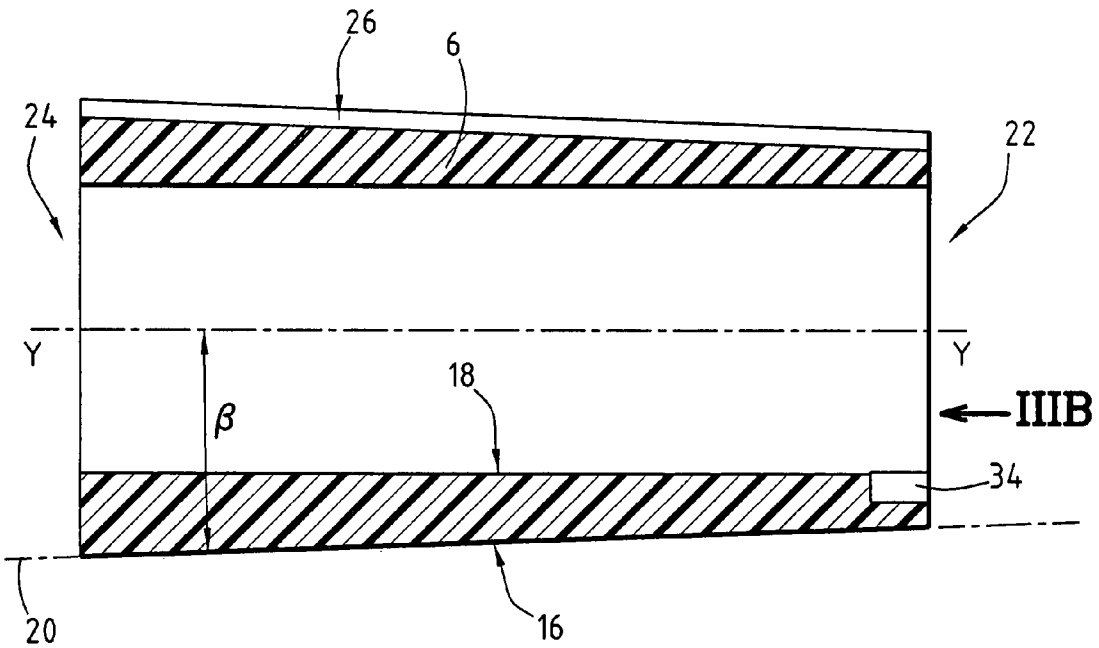
FIG. 3A is an axial section of an adaptation sleeve according to the invention, in the non-mounted state.

As can be seen in FIG. 3A, the adaptation sleeve 6 comprises an outer surface 16 and an inner surface 18. The outer surface 16, when the sleeve 6 is not mounted on the hub 4, has a frustoconical form which is centred on the centre axis Y-Y of the adaptation sleeve 6. When the adaptation sleeve 6 is in the non-mounted state, the inner surface 18 is cylindrical having a circular cross-section about the centre axis Y-Y.

The generating line 20 of the outer surface 16 is inclined relative to the centre axis Y-Y through an angle β. The value of this angle β is identical to the angle α, but the direction of inclination is the opposite of that of angle α.

The sleeve 6 thus defines, in the non-mounted state, an end 22 having a small outer diameter and an end 24 having a large outer diameter.

Furthermore, the adaptation sleeve 6 comprises an axial groove 26 in the outer surface 16 thereof. This groove 26 is suitable for receiving the top edge 28 and bottom edge 30 of a printing plate 32. As can be seen in FIG. 1 and FIG. 2B in cross-section, the axial groove 26 has a shape having an undercut in the radial direction and is, in this instance, in the form of a dovetail, the widened portion being directed towards the centre axis Y-Y.

In the example illustrated, the axial groove 26 has a cross-section which is identical over the entire axial length thereof but, in a variant, the axial groove 26 has a width which increases from one of the axial ends thereof to the other in order to facilitate fitting the edges 28, 30 of the printing plate 32 in the groove 26.

Furthermore, the adaptation sleeve 6 comprises an angular location means which allows the adaptation sleeve 6 to be angularly aligned relative to the hub 4. This location means comprises a recess 34 which is open towards the axis Y-Y and towards the end 22 and which is arranged at this end 22.

FIG. 2A illustrates the hub 4, the sleeve 6 and the printing plate 32 in the mounted state.

The adaptation sleeve 6 is resiliently deformed by the hub 4, so that the inner surface 18 of the adaptation sleeve 6 has a level of conicity which is identical to that of the outer surface 8 of the hub 4. The outer surface 16 of the adaptation sleeve 6 is cylindrical having a circular cross-section about the centre axis X-X.

The axial end 24 of the adaptation sleeve 6 having a large diameter is directed towards the axial end 10 of the hub 4 having a small diameter and the end 22 of the adaptation sleeve 6 having a small diameter is directed towards the end 12 of the hub 4 having a large diameter. The hub 4 thus deforms the adaptation sleeve 6 in such a manner that the outer surface 16 of the sleeve assumes its cylindrical form.

The method for mounting the adaptation sleeve 6 on the hub 4 will be explained below.

Figure 3B:
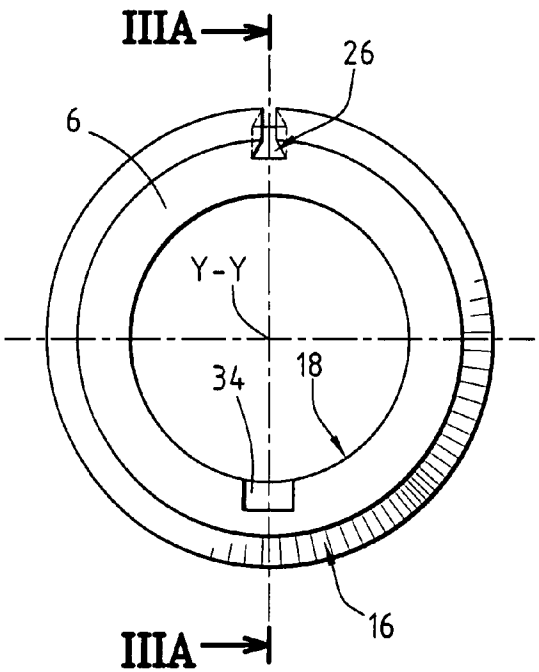
FIG. 3B is an axial view in direction IIIB of FIG. 3A.

Initially, the adaptation sleeve 6 is in the non-mounted state, as illustrated in FIGS. 3A and 3B.

First of all, the end 22 of the sleeve 6 having a small diameter is aligned with the end 10 of the hub 4 having a small diameter. The printing plate 32 is then fitted to the adaptation sleeve 6. Then, the assembly of the adaptation sleeve 6 and the printing plate 32 is axially fitted to the hub 4. The axial force required depends on the level of conicity of the hub 4, the strength of the sleeve 6, and the friction coefficient between the outer surface 8 and inner surface 18. The lower the level of conicity of the outer surface 8, the easier the assembly is.

The adaptation sleeve 6 is fitted to the hub 4 until the entire inner surface 18 thereof is in contact with the outer surface 8 of the hub 4. The outer surface of the sleeve 6 thus becomes cylindrical. By continuing to press the sleeve 6 on the hub 4, the outer diameter thereof increases. This tensions the printing plate.

The axial force required for fitting and removing the adaptation sleeve 6 can be produced by a mechanism which is not illustrated and which is arranged on the hub 4, or, in a variant, by a mechanism which is arranged on the rotary press. A device of this type may be, for example, constituted by an axial screw and nut system acting on a flange which is fixedly joined to the sleeve 6.

In still another variant, the adaptation sleeve 6 and the hub 4 may be blanket cylinders.

The invention claimed is:

1. An assembly of a hub of a cylinder of a rotary press and an adaptation sleeve comprising:

a hub having a frustoconical outer surface; and a format adaptation sleeve having a frustoconical outer surface when the adaptation sleeve is in the non-mounted state;

wherein levels of conicity of the outer surface of the hub and the outer surface of the adaptation sleeve, when the adaptation sleeve is not mounted on the hub, provide a cylindrical outer surface of the adaptation sleeve when the adaptation sleeve is mounted on the hub.

2. The assembly as recited in claim 1 wherein the sleeve has an inner surface, the inner surface being cylindrical when the adaptation sleeve is in the non-mounted state.

3. The assembly as recited in claim 1 wherein the adaptation sleeve is made of resilient material.

4. The assembly as recited in claim 3 wherein the resilient material is glass fiber impregnated with resin.

5. The assembly as recited in claim 1 wherein the outer surface includes an axial groove, the groove receiving a top edge and a bottom edge of a printing plate.

6. The assembly as recited in claim 5 wherein the axial groove has a cross-section with an undercut in the radial direction.

7. The assembly as recited in claim 6 wherein the undercut is in the form of a dovetail.

8. The assembly as recited in claim 6 wherein a circumferential width of the axial groove increases from one end of the axial groove to another end of the axial groove.

9. The assembly as recited in claim 1 wherein the conicity of the outer surface of the hub and the conicity of the outer surface of the adaptation sleeve are identical when the adaptation sleeve is in the non-mounted state.

10. The assembly as recited in claim 1 wherein the adaptation sleeve and the hub each include an end having a large diameter and an end having a small diameter, the end of the adaptation sleeve having a large diameter directed towards the end of the hub having a small diameter, the end of the adaptation sleeve having a small diameter is directed towards the end of the hub having a large diameter when the adaptation sleeve is mounted on the hub.

11. The assembly as recited in claim 1 further comprising a printing plate fitted on the adaptation sleeve.

12. The assembly as recited in claim 11 wherein the printing plate is tensioned by an increase in an outer diameter of the adaptation sleeve.

13. A method for mounting an assembly comprising the steps of:

aligning axially an adaptation sleeve with a hub;

fitting the adaptation sleeve to the hub, the adaptation sleeve being resiliently deformed during the fitting operation to form the assembly recited in claim 1.

* * * * *